US006525625B1

(12) United States Patent
Tsukamoto et al.

(10) Patent No.: US 6,525,625 B1
(45) Date of Patent: Feb. 25, 2003

(54) DIELECTRIC DUPLEXER AND COMMUNICATION APPARATUS

(75) Inventors: Hideki Tsukamoto, Ishikawa-ken (JP); Katsuhito Kuroda, Matto (JP); Jinsei Ishihara, Kanazawa (JP); Hideyuki Kato, Ishikawa-ken (JP)

(73) Assignee: Murata Mfg. Co. Ltd (JP)

( * ) Notice: Subject to any disclaimer, the term of this patent is extended or adjusted under 35 U.S.C. 154(b) by 1 day.

(21) Appl. No.: 09/627,620

(22) Filed: Jul. 28, 2000

(30) Foreign Application Priority Data

Jul. 30, 1999 (JP) ..... 11-216212

(51) Int. Cl.[7] ..... H01P 5/12; H01P 1/20

(52) U.S. Cl. ..... 333/134; 333/202; 333/206

(58) Field of Search ..... 333/202, 206, 333/134

(56) References Cited

U.S. PATENT DOCUMENTS

| | | | | |
|---|---|---|---|---|
| 5,696,473 A | * | 12/1997 | Tsujiguchi et al. | 333/202 |
| 5,867,076 A | * | 2/1999 | Tada et al. | 333/206 |
| 5,886,986 A | | 3/1999 | Lee et al. | 370/276 |
| 5,945,896 A | * | 8/1999 | Miyamoto | 333/206 |
| 6,169,465 B1 | * | 1/2001 | Kim et al. | 333/206 |

FOREIGN PATENT DOCUMENTS

| | | |
|---|---|---|
| EP | 0840390 | 11/1997 |

* cited by examiner

*Primary Examiner*—Patricia Nguyen
(74) *Attorney, Agent, or Firm*—Dickstein Shapiro Morin & Oshinsky

(57) ABSTRACT

A dielectric duplexer has first and second filters passing two adjacent bands and is not influenced by signals in bands that are outwardly adjacent to the two passing bands. The space between small sectional area portions on short-circuit-end sides of first and second resonator holes is arranged to be relatively small, and the two resonator holes are coupled with each other according to a distributed-constant-type inductive coupling method. The space between small sectional area portions on short-circuit-end sides of fourth and fifth resonator holes is arranged to be relatively large, and the two resonator holes are coupled with each other according to a distributed-constant-type capacitive coupling method. Furthermore, the space between small sectional area portions on short-circuit-end sides of the fifth resonator hole and a sixth resonator hole is arranged to be relatively small, and the two resonator holes are coupled with each other according to a distributed-constant-type inductive coupling method. In this way, an attenuation pole is generated on a high-band side of a transmitting band according to the first and second resonator holes. Also, attenuation poles are individually generated on a high-band side and a low-band side of a receiving band according to the fourth, fifth, and sixth resonator holes.

4 Claims, 5 Drawing Sheets

DIELECTRIC DUPLEXER AND COMMUNICATION APPARATUS

BACKGROUND OF THE INVENTION

1. Field of the Invention

The present invention relates to a dielectric duplexer and a communication apparatus using the dielectric duplexer.

2. Description of the Related Art

Conventional filters designed for use in, for example, microwave bands are configured to have resonance lines provided on a dielectric board, a dielectric block, or the like. For example, for bandpass filters, the central frequency of a passing band, passing-band widths, attenuation-pole frequencies, and the like are designed to meet required technical specifications. As particular examples, dielectric filters designed so as to control characteristics over transient regions from passing bands to attenuation bands have been proposed by Japanese Unexamined Patent Application Publications Nos. 62-161202 and 7-321508.

Japanese Unexamined Patent Application Publication No. 62-161202 proposed an antenna duplexer configured of two bandpass filters. One of the bandpass filters has attenuation characteristics with a greater gradient in the direction from a passing band to an attenuation band on the low-band side than in the direction from the passing band to an attenuation band on the high-band side. In contrast, the other of the bandpass filters has attenuation characteristics with a greater gradient in the direction from a passing band to an attenuation band on the high-band side than in the direction from the passing band to an attenuation band on the low-band side.

Japanese Unexamined Patent Application Publication No. 7-321508 proposed a bandpass filter configured of resonators coupled by means of a concentrated-constant-type coupling element. In the bandpass filter, to increase amounts of attenuation in attenuation bands, magnetic coupling is used for interstage coupling in a low-band-side bandpass filter, and capacitive coupling is used for interstage coupling on a high-band-side bandpass filter.

In order to use each of these conventional dielectric filters as an antenna duplexer, a configuration can be such that attenuation poles are individually provided in a high band of the low-band-side bandpass filter and in a low band of the high-band-side bandpass filter. This configuration can produce attenuation characteristics which sharply change in a direction from one of the passing bands to the other one of the passing bands. However, a problem arises in that the antenna duplexer is influenced by waves (noise waves) in an adjacent frequency band: namely, in a band of higher or lower frequency than the high or low passing bands.

SUMMARY OF THE INVENTION

Accordingly, an object of the present invention is to provide a dielectric duplexer that has first and second filters passing two adjacent bands and that is not influenced by signals in bands that are adjacent to and outside the two passing bands.

Another object of the present invention is to provide a communication apparatus using the aforementioned dielectric duplexer.

To these ends, according to one aspect of the present invention, there is provided a dielectric duplexer, comprising: a first filter having a plurality of resonance lines provided on a dielectric member, for passing a lower-side band; and a second filter having a plurality of resonance lines provided on the dielectric member, for passing a higher-side band; wherein adjacent resonance lines of the first filter are coupled at their predetermined portions to each other by distributed-constant-inductive coupling, so as to generate an attenuation pole in the high-frequency side of the passing band, while adjacent resonance lines of the second filter are coupled at their predetermined portions to each other by distributed-constant-capacitive coupling, so as to generate an attenuation pole in the low-frequency side of the passing band, and wherein adjacent resonance lines of the second filter are coupled at their other portions to each other by distributed-constant-inductive coupling, so as to generate an attenuation pole also in the high-frequency side of the passing band of the second filter.

According to another aspect of the present invention, there is provided a dielectric duplexer, comprising: a first filter having a plurality of resonance lines provided on a dielectric member, for passing a lower-side band; and a second filter having a plurality of resonance lines provided on the dielectric member, for passing a higher-side band; wherein adjacent resonance lines of the first filter are coupled at their predetermined portions to each other by distributed-constant-inductive coupling, so as to generate an attenuation pole in the high-frequency side of the passing band, while adjacent resonance lines of the second filter are coupled at their predetermined portions to each other by distributed-constant-capacitive coupling, so as to generate an attenuation pole in the low-frequency side of the passing band, and wherein adjacent resonance lines of the first filter are coupled at their other portions to each other by distributed-constant-capacitive coupling, so as to generate an attenuation pole also in the low-frequency side of the passing band of the first filter.

With these features, it is possible to realize sharp attenuations not only in the higher-frequency side of the first filter that passes lower frequency band and the lower-frequency side of the second filter that passes higher frequency band, but also at the lower-frequency side of the first filter and at the higher-frequency side of the second filter, whereby influences of signals which are outside and adjacent to the two passing bands can be significantly suppressed.

The arrangement may be such that the dielectric member is a substantially rectangular parallelepiped dielectric block, and the resonance lines are constituted by inner conductors in resonator holes formed in the dielectric block, and wherein the distributed-constant-inductive coupling or the distributed-constant-capacitive coupling is implemented by determining the distance between portions of adjacent resonator holes near the open-circuit ends of the resonator holes and the distance between portions of the adjacent resonator holes near the short-circuit ends of the resonator holes.

With this arrangement, it is possible to obtain a dielectric multiplexer which is easy to manufacture and which can suppress unnecessary frequency signals outside the two passing bands, by using a single dielectric block and suitably determining the configurations of the resonator holes.

The arrangement also may be such that the dielectric member is a substantially rectangular parallelepiped dielectric block, and the resonance lines are constituted by inner conductors in resonator holes formed in the dielectric block, and wherein the distributed-constant-inductive coupling or the distributed-constant-capacitive coupling is implemented by determining the effective inductivity between portions of adjacent resonator holes near the open-circuit ends of the resonator holes and the effective inductivity between portions of the adjacent resonator holes near the short-circuit ends of the resonator holes.

With this arrangement, it is possible to obtain a dielectric multiplexer which can suppress unnecessary frequency signals outside the two passing bands, by using a single dielectric block and by suitably determining the effective inductivities at predetermined portions of the dielectric block. Thus, the characteristics of the dielectric duplexer can be determined by the outer shape of the dielectric block, and can easily be adjusted from the exterior of the dielectric block.

The arrangement also may be such that the dielectric member is a substantially rectangular parallelepiped dielectric block, and the resonance lines are constituted by inner conductors in resonator holes formed in the dielectric block, and wherein the distributed-constant-inductive coupling or the distributed-constant-capacitive coupling is implemented by determining the opposing area of the inner conductors of adjacent resonator holes near the open-circuit ends of the resonator holes and the opposing area of the inner conductors of the adjacent resonator holes near the short-circuit ends of the resonator holes.

With this arrangement, it is possible to obtain a dielectric multiplexer which can suppress unnecessary frequency signals outside the two passing bands, by using a single dielectric block and by suitably determining the regions where the inner conductors of the resonator holes are to be formed. Thus, the characteristics of the dielectric demultiplexer can be determined by partial removal of the inner conductors, and can easily be adjusted from the exterior of the dielectric block.

The arrangement also may be such that the dielectric member is a substantially rectangular parallelepiped dielectric block, and the resonance lines are constituted by inner conductors in resonator holes formed in the dielectric block, the dielectric block having conductor patterns formed on the external surface thereof and continuing from the inner conductors, and wherein the distributed-constant-inductive coupling or the distributed-constant-capacitive coupling is implemented by determining the electrostatic capacitance between portions of adjacent resonance lines near the open-circuit ends of the resonator lines and the electrostatic capacitance between the open-circuit end of the resonance line and the external conductor formed on the external surface of the dielectric block.

With this arrangement, it is possible to obtain a dielectric multiplexer which is easy to manufacture and which can suppress unnecessary frequency signals outside the two passing bands, by using a single dielectric block and by suitably designing conductor patterns on the external surface of the dielectric block. Thus, the characteristics of the dielectric multiplexer can easily be determined and adjusted by suitably determining the conductor pattern.

Alternatively, the dielectric member may be a dielectric board. In such a case, the arrangement may be such that the resonance lines are constituted by microstrip lines formed on the dielectric board, and wherein the distributed-constant-inductive coupling or the distributed-constant-capacitive coupling is implemented by determining the distance between portions of adjacent microstrip lines near the open-circuit ends of the microstrip lines and the distance between portions of the adjacent microstrip lines near the short-circuit ends of the microstrip lines.

This arrangement permits the dielectric multiplexer to be manufactured with a reduced number of production steps and, hence, at a reduced cost, because the dielectric member is formed of a board.

In accordance with another aspect of the present invention, there is provided a communication apparatus comprising: a transmitting circuit connected to an input port of the first filter of the dielectric duplexer of any type described heretofore; a receiving circuit connected to an output port of the second filter of the dielectric duplexer; and an antenna connected to a common input/output port of the first and second filters.

With these features, it is possible to obtain a small-sized, lightweight communication apparatus, by virtue of the use of the dielectric duplexer which, despite a reduced size, exhibits required characteristics.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
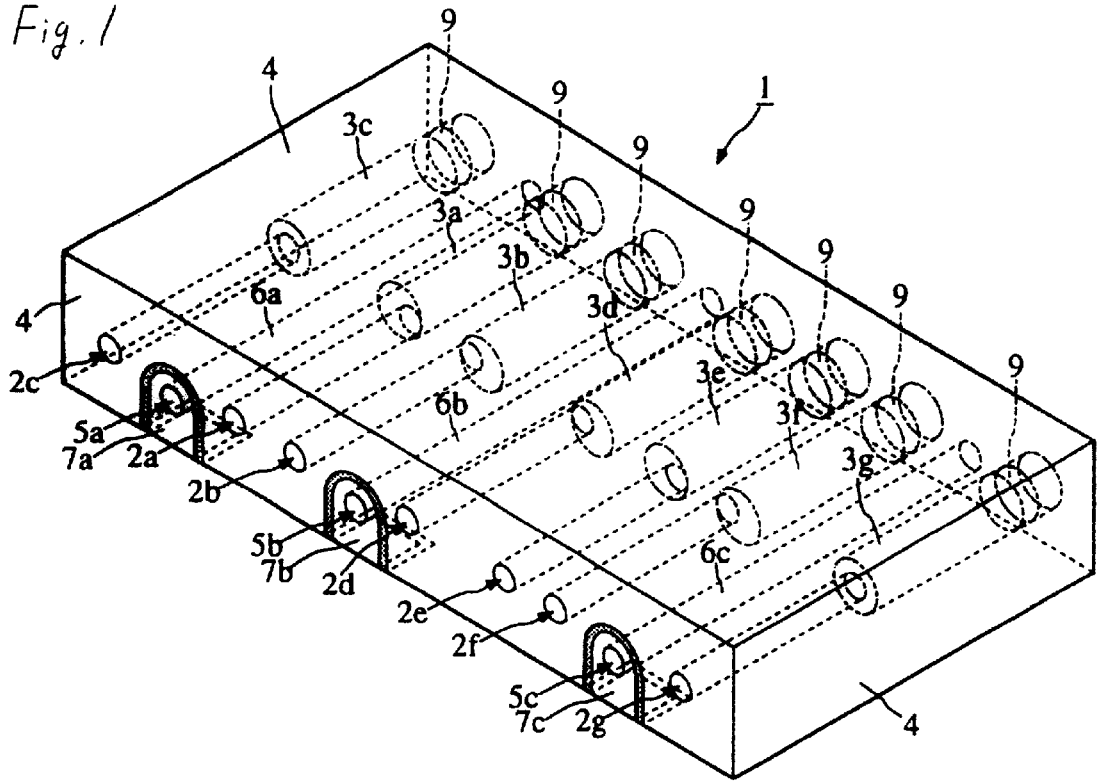
FIG. 1 is an overall perspective view of a dielectric duplexer of first embodiment.
Figure 6A:
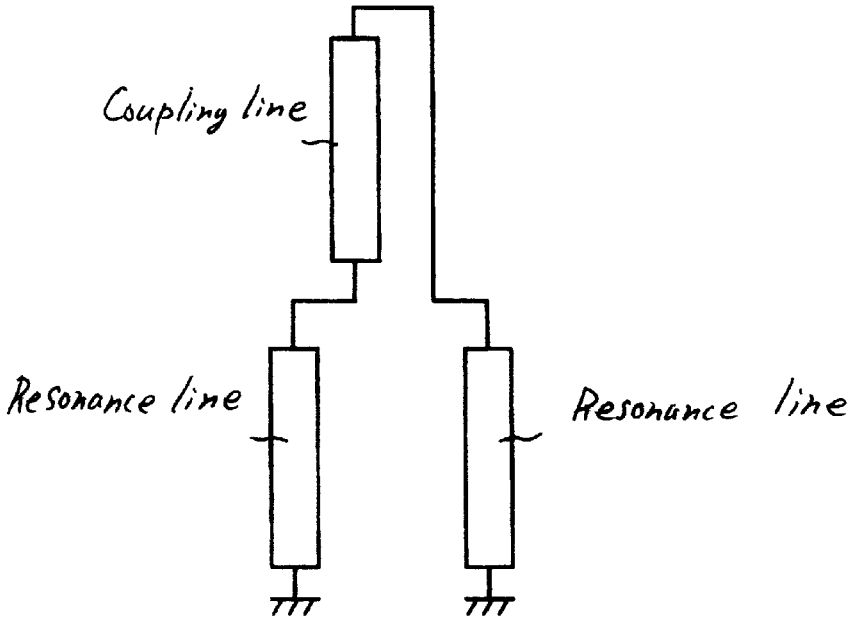
FIG. 6A is circuit diagram of a distributed-constant-type coupling circuit.
Figure 6B:
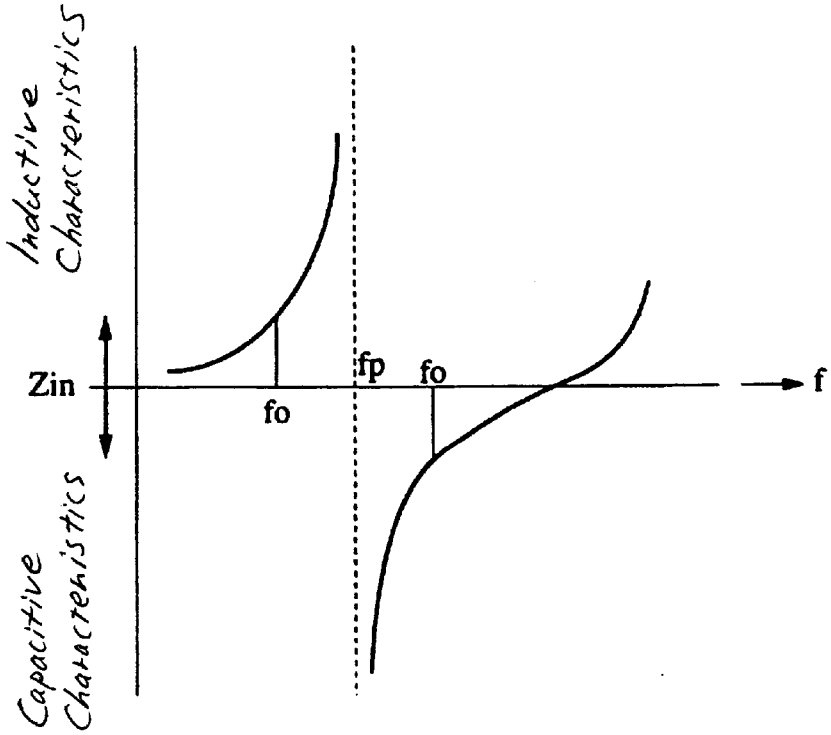
FIG. 6B is a graph showing impedance characteristics of a coupling line in the circuit in FIG. 6A.
Figure 7:
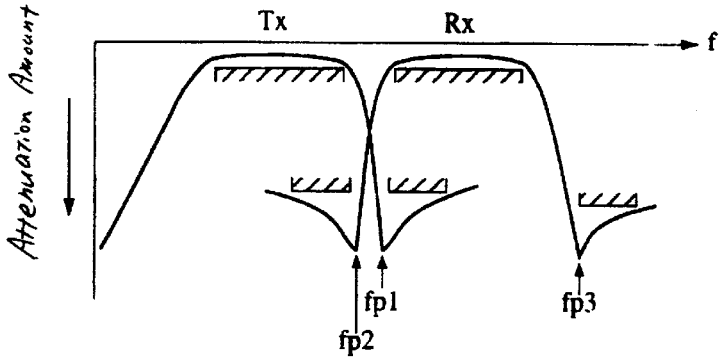
FIG. 7 shows passing characteristics of the dielectric duplexer according to the present invention.

Referring to FIGS. 1, 6, and 7, a description will be given of a dielectric duplexer of a first embodiment of the present invention.

FIG. 1 is an overall perspective view of the dielectric duplexer according to the first embodiment. As shown in the figure, resonator holes 2*a* to 2*g* and excitation holes 5*a* to 5*c* are formed in a dielectric block 1 that is substantially in a rectangular-parallelepiped shape. The resonator holes 2*a* to 2*g* and the excitation holes 5*a* to 5*c* are substantially parallel to each other. Each of the resonator holes 2*a* to 2*g* is a stepped hole that has the bore diameter varying en route in a step-like shape. The resonator holes 2*a* to 2*g* have inner faces on which inner conductors 3*a* to 3*g* are formed, respectively, as resonance lines. A part of each of the inner conductors 3*a* to 3*g* is used as a non-inner-conductor section 9. The excitation holes 5*a* to 5*c* have inner faces on which inner conductors 6*a* to 6*c* are formed, respectively.

Outer conductors 4 are formed on six outer faces of the dielectric block 1. Input/output electrodes 7*a* to 7*c* individually continue from the inner conductors 6*a* to 6*c*, and each of them is formed at one end of each of the excitation holes 5*a* to 5*c* so as to be isolated from the outer conductors 4. The input/output electrodes 7*a*, 7*b*, and 7*c* are used, respectively, as a transmitted-signal input terminal. (Tx terminal), an antenna terminal (ANT terminal), a received-signal output terminal (Rx terminal).

The central axis of each small-bore portion (which will be referred to as a small sectional area portion, hereinbelow) of the resonator holes 2*a* to 2*g* is not restricted to be aligned with the central axis of each large-bore portion (which will be referred to as a large sectional area portion). The space between the small sectional area portions and the space between the large sectional area portions of adjacent resonator holes are determined as required.

In the example shown in FIG. 1, resonance frequencies of individual resonators formed of the resonator holes 2*a* and 2*b* are predetermined to be substantially the same so as to pass transmitting frequency bands (which will be referred to as transmitting bands, hereinbelow). The space between the central axes of the small sectional area portions on short-circuit-end sides of the resonator holes 2*a* and 2*b* is arranged smaller than the space between the central axes of the large sectional area portions on the open-circuit-end sides thereof. According to this arrangement, coupling areas on the short-circuit-end sides having high magnetic-field strengths are arranged to be larger than coupling areas on the open-circuit-end sides having high electrical strengths, and the resonator holes 2*a* and 2*b* are thereby coupled with each other according to a distributed-constant-type inductive coupling method.

The resonance line of the resonator hole 2*a* and an excitation line of the excitation hole 5*a* are coupled with each other according to an interdigital coupling method. Similarly, coupling according to the interdigital coupling method is implemented between the resonance line of the resonator hole 2*b* and an excitation line of the excitation hole 5*b* and between the resonance line of the resonator hole 2*c* and an excitation line of the excitation hole 5*c*. In this configuration, a resonator formed of the resonator hole 2*c* works as a trap filter.

Resonance frequencies of individual resonators formed of the resonator holes 2*d*, 2*e* and 2*f* are predetermined to be substantially the same so as to pass received frequency bands (which will be referred to as receiving band, hereinbelow). For the resonator holes 2*d* and 2*e*, the space between the central axes of the small sectional area portions thereof is arranged larger than the space between the central axes of the large sectional area portions. According to this arrangement, the resonator holes 2*d* and 2*e* are coupled with each other according to a distributed-constant-type capacitive coupling method. On the other hand, for the resonator holes 2*e* and 2*f*, the space between the central axes of the small sectional area portions thereof is arranged smaller than the space between the central axes of the large sectional area portions thereof. According to this arrangement, the resonator holes 2*e* and 2*f* are coupled with each other according to the distributed-constant-type inductive coupling method. The interdigital coupling is implemented between the excitation hole 5*b* and the resonator hole 2*f*, between the excitation hole 5*c* and the resonator hole 2*f*, and between the resonance line of the resonator hole 2*g* and an excitation line of the excitation hole 5*c*. In this configuration, a resonator formed of the resonator hole 2*g* works as a trap filter.

FIG. 6A shows a distributed-constant-type coupling circuit. In the shown configuration, when each of the lengths of two resonance lines is represented by L, impedance of a coupling line is represented by $Z_o$, and phase constant thereof is represented by β, an impedance $Z_{in}$ (when the coupling line is viewed from the resonance lines) is expressed by the following expression:

$$Z_{in}=jZ_o\tan\beta L$$

FIG. 6B shows the relationship between a frequency f and the aforementioned impedance $Z_{in}$. Since the impedance $Z_{in}$ is infinite as a resonance condition, the frequency of the attenuation pole is positioned as indicated by $f_p$ in FIG. 6B. When two resonators are capacitively coupled with each other, a resonance frequency $f_o$ is positioned higher than the attenuation pole $f_p$. This indicates that the attenuation pole occurs in a band lower than a passing band. In contrast, when two resonators are inductively coupled with each other, since the resonance frequency $f_o$ is positioned lower than the attenuation pole $f_p$, the attenuation pole occurs in a band higher than the passing band.

The resonator holes 2*a* and 2*b* shown in FIG. 1 are related to each other according to the distributed-constant-type inductive coupling. Therefore, according to the coupling between the two resonators, the attenuation pole occurs on a high-band side of the transmitting band. Also, the attenuation frequency according to the resonator hole 2*c* is substantially the same as the attenuation-pole frequency according to the distributed-constant-type inductive coupling.

As described above, the resonator holes 2*d* and 2*e* are related to each other according to the distributed-constant-type capacitive coupling. Therefore, the attenuation pole occurs on a low-band side of the receiving band. On the other hand, the resonator holes 2*e* and 2*f* are related to each other according to the distributed-constant-type inductive coupling. Therefore, the attenuation pole occurs on a high-band side of the receiving band. The attenuation frequency according to the resonator hole 2*g* is arranged to be substantially the same as the attenuation frequency according to the aforementioned distributed-constant-type capacitive coupling.

FIG. 7 is a graph showing band-passing characteristics of the dielectric duplexer shown in FIG. 1. In the graph, $f_{p1}$ indicates an attenuation pole that occurs on a high-band side of a passing band in a transmitting filter. Also, $f_{p2}$ indicates an attenuation pole that occurs on a low-band side of a passing band in a receiving filter, and $f_{p3}$ indicates an attenuation pole that occurs on a high-band side of the passing band in the receiving filter.

In this way, synthesized characteristics can be obtained for the area between the input/output electrodes 7*a* and 7*b* from band-passing characteristics according to two resonators, attenuation characteristics according to the distributed-constant-type inductive coupling, and trap-filter characteristics according to the resonator hole 2*c*. In addition, synthesized characteristics can be obtained for the area between the input/output electrodes 7*b* and 7*c* from band-passing characteristics according to three resonators, two types of attenuation characteristics (attenuation characteristics according to the distributed-constant-type capacitive coupling and attenuation characteristics according to the distributed-constant-type inductive coupling), and trap-filter characteristics according to the resonator hole 2*g*.

Hereinbelow, a description will be given of a dielectric duplexer according to a second embodiment of the present invention.

Figure 2:
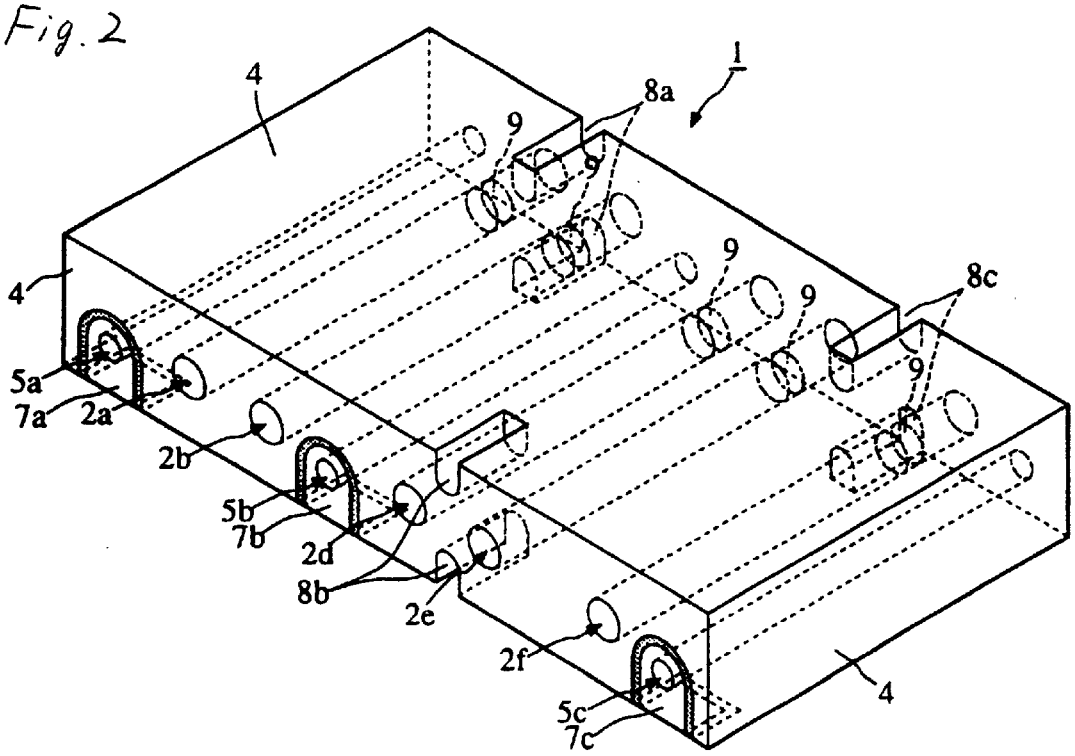
FIG. 2 is an overall perspective view of a dielectric duplexer of a second embodiment.

FIG. 2 shows the dielectric duplexer of the second embodiment. In the second embodiment, resonator holes 2*a*, 2*b*, 2*d*, 2*e*, and 2*f* and excitation holes 5*a* to 5*c* are formed in a dielectric block 1 that is substantially in a rectangular-parallelepiped shape. The resonator holes 2*a*, 2*b*, 2*d*, 2*e*, and 2*f* and the excitation holes 5*a* to 5*c* are substantially parallel to each other. outer conductors 4 are continuously formed on six outer faces of the dielectric block 1. Inner conductors are formed on individual inner faces of the resonator holes 2*a*, 2*b*, 2*d*, 2*e*, and 2*f*; and as a resonance line, a non-inner-conductor section 9 is provided in the vicinity of one of opening faces of each of the resonator holes 2*a*, 2*b*, 2*d*, 2*e*, and 2*f*. As a resonance line, an inner conductor is formed on each inner face of the excitation openings 5*a* to 5*c*. Each of input/output electrodes 7*a* to 7*c* isolated from the outer conductors 4 is formed continually from one of opening faces of each of the excitation openings 5*a* to 5*c* to the bottom face (when viewed in FIG. 2). The input/output electrodes 7*a*, 7*b*, and 7*c* are used, respectively, as a transmitted-signal input terminal (Tx terminal), an antenna terminal (ANT terminal), a received-signal output terminal (Rx terminal).

In the second embodiment, slits 8*a* to 8*c* are formed on the outer face of the dielectric block 1. The slits 8*a* are individually formed on the side of the open-circuit end between the resonator holes 2*a* and 2*b*. The slits 8*b* are individually formed on the side of the short-circuit end between the resonator holes 2*d* and 2*e*. The slits 8*c* are individually formed on the side of the open-circuit end between the resonator holes 2*e* and 2*f*. On each face of these slits 8*a* to 8*c*, an outer conductor may be provided, or may not be provided.

According to the above-described configuration, an effective permittivity between the open-circuit ends of the resonator holes 2*a* and 2*b* is reduced lower than that between the short-circuit ends thereof. Also,. the effective permittivity between the short-circuit ends of the resonator holes 2*d* and 2*e* is reduced lower than that between the short-circuit ends thereof. Similarly, the effective permittivity between the open-circuit ends of the resonator holes 2*e* and 2*f* is reduced lower than that between the short-circuit ends thereof.

Accordingly, the resonators are coupled with each other as follows. Two resonators individually formed of the resonator holes 2*a* and 2*b* are coupled with each other according to the distributed-constant-type inductive coupling method. Two resonators individually formed of the resonator holes 2*d* and 2*e* are coupled with each other according to the distributed-constant-type capacitive coupling method. Two resonators individually formed of the resonator holes 2*e* and 2*f* are coupled with each other according to the distributed-constant-type inductive coupling method. Also, coupling according to the interdigital coupling method is implemented between the excitation line of the excitation hole 5*a* and the resonance line of the resonator hole 2*b*, between the excitation line of the excitation holes 5*a* and the resonator hole 2*d*, and between the excitation line of the excitation hole 5*c* and the resonance line of the resonator hole 2*f*.

In the above-described way, the two resonators individually formed of the resonator holes 2*a* and 2*b* are used to form a transmitting filter that passes transmitting bands of the lower-side band. Similarly, the resonator holes 2*d*, 2*e*, and 2*f* are used to form a receiving filter that passes receiving bands of the higher-frequency-side band. According to the inductive coupling in the transmitting filter, similarly to the characteristics shown in FIG. 7, attenuation characteristics represented by a graph line curve that sharply curves in a direction from the transmission band to the receiving band is obtained. Also, according to the capacitive coupling and the inductive coupling in the receiving filter, attenuation characteristics represented by a graph line curve that sharply curves in a direction from the receiving band to the transmitting band is obtained. Furthermore, according to the above, a large amount of attenuation in a band higher than the receiving band can be secured.

Hereinbelow, a description will be given of a dielectric duplexer according to a third embodiment of the present invention.

Figure 3:
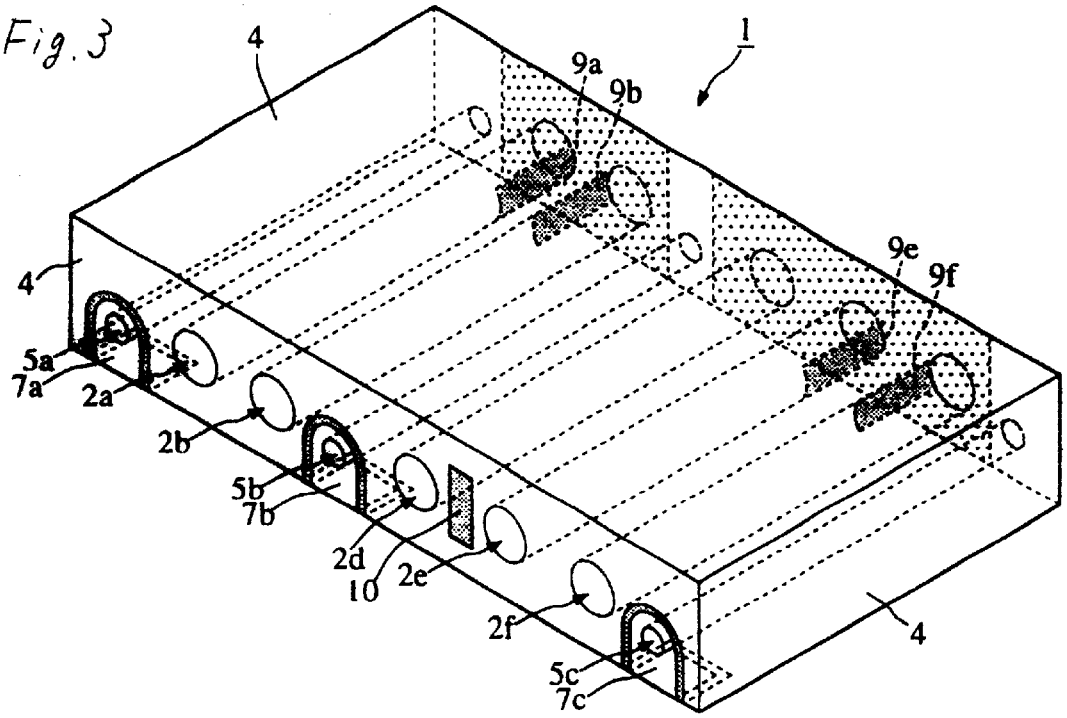
FIG. 3 is an overall perspective view of a dielectric duplexer of a third embodiment.

FIG. 3 is a perspective view showing the configuration of the dielectric duplexer of the third embodiment. Similarly to the described embodiments, resonator holes 2*a*, 2*b*, 2*d*, 2*e*, and 2*f* and excitation holes 5*a* to 5*c* are formed in a dielectric block 1 that is substantially in a rectangular-parallelepiped shape. The resonator holes 2*a*, 2*b*, 2*d*, 2*e*, and 2*f* and the excitation holes 5*a* to 5*c* are substantially parallel to each other. In the figure, a right-and-rear area close to one of opening sections of each of the resonator holes 2*a*, 2*b*, 2*d*, 2*e*, and 2*f* in the dielectric block 1 is used as an open-circuit face. On the same face as mentioned above, an outer conductor is formed in one of opening sections of each of the excitation openings 5*a* to 5*c*. Outer conductors 4 are also formed on the remaining faces of the dielectric block 1. As a resonance line, an inner conductor is formed on an inner face of each of the resonator holes 2*a*, 2*b*, 2*d*, 2*e*, and 2*f*. In the individual vicinities of open-circuit ends of the individual resonator holes 2*a* and 2*b*, non-inner-conductor sections 9*a* and 9*b* each extending in the axial direction are formed on faces opposing each other. Thereby, capacitive components of two resonators individually formed of the resonator holes 2*a* and 2*b* are reduced, and the two resonators are coupled with each other according to the distributed-constant-type inductive coupling method. Similarly, for resonator holes 2*e* and 2*f*, non-inner-conductor sections 9*e* and 9*f* each extending in the axial direction are formed on faces opposing each other. Thereby, capacity components of two resonators individually formed of the resonator holes 2*e* and 2*f* are reduced, and the two resonators are coupled with each other according to the distributed-constant-type inductive coupling method.

In addition, a non-outer-conductor section 10 is formed between short-circuit ends of the resonator holes 2*d* and 2*e*. Thereby, the degree of inductive coupling between the resonator holes 2*d* and 2*e* is reduced lower than that of capacitive coupling therebetween, and the two resonators are coupled with each other according to the distributed-constant-type capacitive coupling method.

As a resonance line, an inner conductor is formed on each inner face of the excitation openings 5*a* to 5*c*. Each of input/output electrodes 7*a* to 7*c* isolated from the outer conductors 4 is formed continually from one of opening faces of each of the excitation openings 5*a* to 5*c* to the bottom face (when viewed in FIG. 3). The input/output electrodes 7*a*, 7*b*, and 7*c* are used, respectively, as a transmitted-signal input terminal (Tx terminal), an antenna terminal (ANT terminal), and a received-signal output terminal (Rx terminal). According to the described configuration, the third embodiment produces band-passing characteristics similar to those shown in FIG. 7.

Hereinbelow, a description will be given of a dielectric duplexer according to a fourth embodiment of the present invention.

Figure 4:
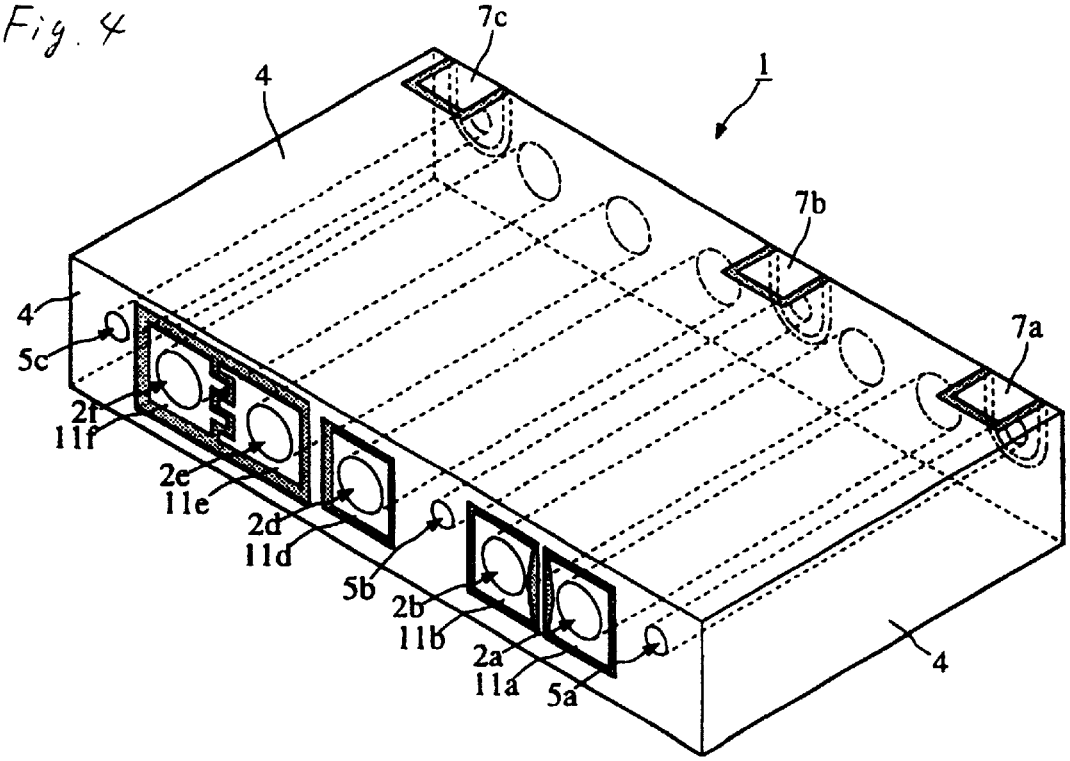
FIG. 4 is an overall perspective view of a dielectric duplexer of a fourth embodiment.

FIG. 4 is an overall perspective view showing the configuration of the dielectric duplexer of the fourth embodiment. Different from the embodiments in FIGS. 1 to 3, the dielectric duplexer of the fourth embodiment is shown up-side down, in which a mounting face for mounting base plate is shown as the upper face.

Similarly to the described embodiments, resonator holes 2*a*, 2*b*, 2*d*, 2*e*, and 2*f* and excitation holes 5*a* to 5*c* are formed in a dielectric block 1 that is substantially in a rectangular-parallelepiped shape. The resonator holes 2*a*, 2*b*, 2*d*, 2*e*, and 2*f* and the excitation holes 5*a* to 5*c* are substantially parallel to each other. Outer conductors 4 are formed on six outer face of the dielectric block 1. On the outer faces of the dielectric block 1, each of open-circuit electrodes 11*a*, 11*b*, 11*d*, 11*e*, and 11*f* is formed in the vicinity of one of opening faces of each of the resonator holes 2*a*, 2*b*, 2*d*, 2*e*, and 2*f*. Each of the open-circuit electrodes 11*a*, 11*b*, 11*d*, 11*e*, and 11*f* is continually formed from an inner conductor of each of the resonator holes 2*a*, 2*b*, 2*d*, 2*e*, and 2*f* so as to be isolated from the outer conductors 4.

Two adjacent resonators capacitively are coupled with each other when an electrostatic capacity between the open-circuit electrodes is increased, and the two resonators inductively are coupled with each other when an electrostatic capacity between the open-circuit electrode and the outer conductor 4 is increased. The ratio of the above-mentioned two capacities determines whether, as a whole, the two adjacent resonators conductively will be capacitively coupled with each other or will be inductively coupled with each other. In the example shown in FIG. 4, two resonators individually formed of the resonator holes 2*a* and 2*b* are inductively coupled with each other, two resonators individually formed of the resonator holes 2*d* and 2*e* are inductively coupled with each other, and two resonators individually formed of the resonator holes 2*e* and 2*f* are capacitively coupled with each other.

According to the described configuration, the fourth embodiment produces band-passing characteristics similar to those shown in FIG. 7.

Hereinbelow, a description will be given of a dielectric duplexer according to a fifth embodiment of the present invention.

Figure 5:
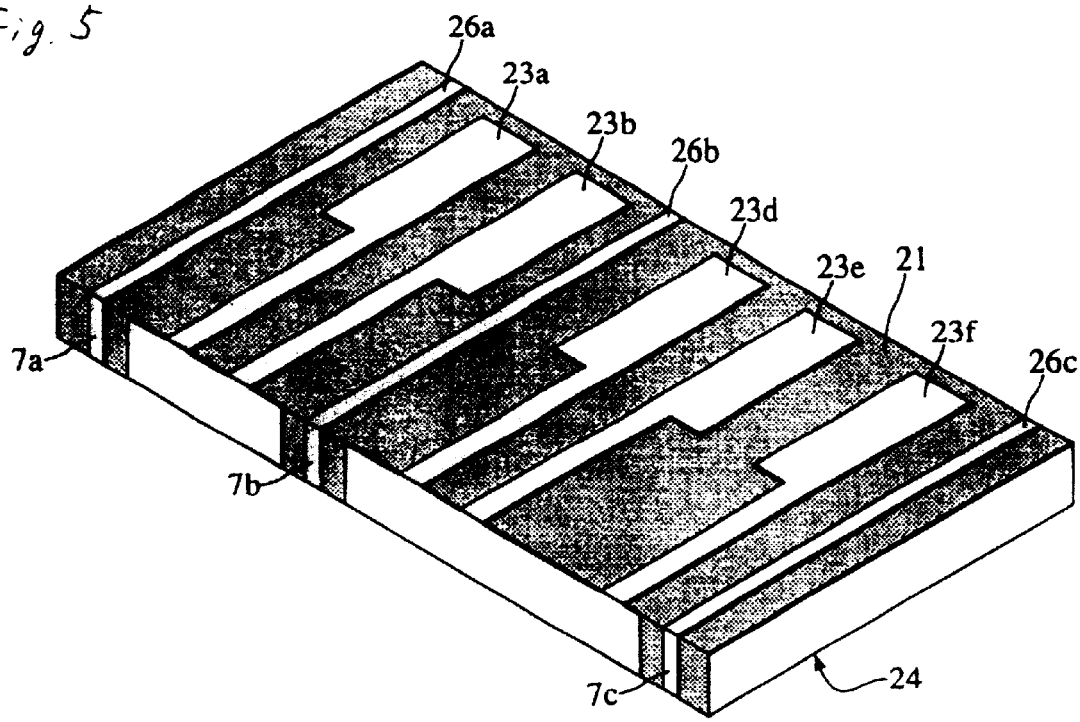
FIG. 5 is an overall perspective view of a dielectric duplexer of a fifth embodiment.

FIG. 5 is an overall perspective view of the dielectric duplexer according to the fifth embodiment.

As shown in the figure, resonance lines 23*a*, 23*b*, 23*d*, 23*e*, and 23*f* and excitation lines 26*a*, 26*b*, and 26*c* are provided on a dielectric board 21. On the substantially entire lower face of the dielectric board 21, a grounding electrode 24 is formed. In the figure, grounding electrodes each continuing-from the lower face are also formed on a right-and-rear end face, a right-and-front end face, and a left-and-rear end face. The individual resonance lines 23*a*, 23*b*, 23*d*, 23*e*, and 23*f* are connected to the grounding electrode 24 formed substantially on the entire reverse face of the dielectric board 21 via the left-and-front end face. One end section of each of the excitation lines 26*a*, 26*b*, and 26*c* is connected to the grounding electrode formed on the right-and-rear end face; and the other end section the excitation lines 26*a*, 26*b*, and 26*c* is formed as each of input/output electrodes 7*a* to 7*c*. The input/output electrodes 7*a*, 7*b*, and 7*c* are, respectively, used as a transmitted-signal input terminal (Tx terminal), an antenna terminal (ANT terminal), and a received-signal output terminal (Rx terminal).

According to the fifth embodiment, each of the resonance lines 23*a*, 23*b*, 23*d*, 23*e*, and 23*f* is formed in a stepped shape having a thin portion and a wide portion. The space between each pair of adjacent resonance lines on the short-circuit-end sides and the space therebetween on the open-circuit-end sides are determined as required. In the example in FIG. 5, resonance frequencies of the resonance lines 23*a* and 23*b* are determined to be substantially the same so as to pass transmitting bands. Also, for the resonance lines 23*a* and 23*b*, the space between the short-circuit ends thereof is arranged smaller than the space between the open-circuit ends thereof so that resonators individually formed by the resonance lines 23*a* and 23*b* are coupled with each other according to the distributed-constant-type inductive coupling method. The resonance line 23*a* and the excitation line 26*a* are coupled with each other according to the interdigital coupling method. Similarly, the resonance line 23*b* and the excitation line 26*b* are coupled with each other according to the interdigital coupling method.

Resonance frequencies of individual resonators formed of the resonator holes 23*d*, 23*e* and 23*f* are predetermined to be substantially the same so as to pass receiving frequency bands. For the resonance line 23*d* and 23*e*, the space between the short-circuit ends is arranged smaller than the space between the open-circuit ends so that the resonators are coupled with each other according to distributed-constant-type inductive coupling method. On the other hand, for the resonance lines 23*e* and 23*f*, the space between the short-circuit ends is arranged larger than the space between the open-circuit ends so that the resonators are coupled with each other according to distributed-constant-type capacitive coupling method. In this case, the resonance line 23*d* and the excitation line 26*b* are coupled with each other according to interdigital coupling method. Similarly, the resonance line 23*f* and the excitation line 26*c* are coupled with each other according to interdigital coupling method.

In this way, synthesized characteristics can be obtained for the area between the input/output electrodes 7*a* and 7*b* from band-passing characteristics according to two resonators and attenuation characteristics according to the distributed-constant-type inductive coupling. In addition, synthesized characteristics can be obtained for the area between the input/output electrodes 7*b* and 7*c* from band-passing characteristics according to three resonators and two types of attenuation characteristics (attenuation characteristics according to the distributed-constant-type capacitive coupling and the attenuation characteristics according to the distributed-constant-type inductive coupling).

Hereinbelow, a description will be given of a communication apparatus according to the present invention.

Figure 8:
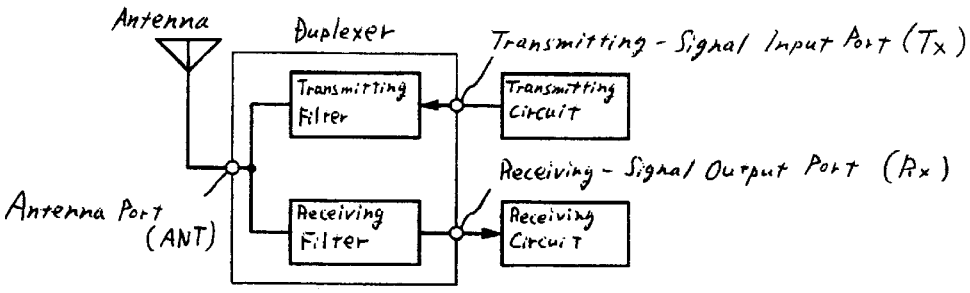
FIG. 8 shows a configuration of a communication apparatus according to the present invention.

FIG. 8 shows a configuration of the communication apparatus using one of the dielectric duplexers having the configuration shown in FIGS. 1 to 5. The dielectric duplexer includes a transmitting filter and a receiving filter. In the dielectric duplexer, a transmitting circuit is connected to a transmitting-signal input port, a receiving circuit is connected to a receiving-signal output port, and an antenna is connected to an antenna port.

In this way, use of the duplexer having good characteristics in the attenuation of opposing bands allows overflow of transmitting signals into the receiving circuit and overflow of receiving signals into the transmitting circuit to be securely suppressed. Also, since the receiving filter attenuates waves (noise waves) in other frequency bands that are closed to the high-band side of the receiving band, the communication apparatus is not influenced by unnecessary receiving signals. In addition, additional components and circuits are not required to obtain attenuation characteristics represented by a graph line curve that sharply curves in a direction from the passing bands to attenuation bands on either the low-band side or high-band side. Therefore, a communication apparatus that is relatively small and light as a whole can be obtained.

The individual embodiments described above are configured such that the higher-frequency-band side is used as the transmitting band, the higher-frequency-band side is used as the receiving band, and the attenuation pole occurs on the high-band side of the receiving band. However, a configuration may be such that, conversely, the higher-frequency-band side is used as the receiving band, the higher-frequency-band side is used as the transmitting band, and the attenuation pole occurs on the low-band side of the receiving band.

Also, the individual embodiments described above are configured such that, so as not to be influenced by unnecessary signals such as noise waves of frequencies that are closed to the receiving band, the attenuation characteristics are produced that are represented by the graph line curve that sharply curves in the attenuation bands departing from the receiving-signal passing band toward the transmitting band, and two attenuation poles occur on the receiving filter side. Conversely, however, a configuration may be such that, to reduce the influence to other apparatuses using frequencies that are close to the receiving band, attenuation characteristics are produced that are represented by graph line curves that sharply curve in the attenuation bands departing from the transmitting-signal passing bands toward the receiving band, and two attenuation poles occur on the-transmitting filter side.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric duplexer, comprising:

a first filter having a plurality of resonance lines provided on a dielectric member, for passing a lower-side band; and a second; filter having a plurality of resonance lines provided on said dielectric member, for passing a higher-side band;

wherein adjacent resonance lines of said first filter are coupled at their predetermined portions to each other by distributed-constant-inductive coupling, so as to generate an attenuation pole in the high-frequency side of the passing band, while adjacent resonance lines of said second filter are coupled at their predetermined portions to each other by distributed-constant-capacitive coupling, so as to generate an attenuation pole in the low-frequency side of the passing band, and wherein adjacent resonance lines of said second filter are coupled at their other portions to each other by distributed-constant-inductive coupling, so as to generate an attenuation pole also in the high-frequency side of the passing band of said second filter;

wherein said dielectric member is a substantially rectangular parallelepiped dielectric block, and said resonance lines are constituted by inner conductors in resonator holes formed in said dielectric block, said dielectric block having conductor patterns formed on the external surface thereof and continuing from said inner conductors, and wherein the distributed-constant-inductive coupling or the distributed-constant-capacitive coupling is implemented by determining the electrostatic capacitance between portions of adjacent resonance lines near the open-circuit ends of the resonator lines and the electrostatic capacitance between the open-circuit end of the resonance line and the external conductor formed on the external surface of said dielectric block.

2. A dielectric duplexer, comprising:

a first filter having a plurality of resonance lines provided on a dielectric member, for passing a lower-side band; and a second filter having a plurality of resonance lines provided on said dielectric member, for passing a higher-side band;

wherein adjacent resonance lines of said first filter are coupled at their predetermined portions to each other by distributed-constant-inductive coupling, so as to generate an attenuation pole in the high-frequency side of the passing band, while adjacent resonance lines of said second filter are coupled at their predetermined portions to each other by distributed-constant-capacitive coupling, so as to generate an attenuation pole in the low-frequency side of the passing band, and wherein adjacent resonance lines of said first filter are coupled at their other portions to each other by distributed-constant-capacitive coupling, so as to generate an attenuation pole also in the low-frequency side of the passing band of said first filter;

wherein said dielectric member is a substantially rectangular parallelepiped dielectric block, and said resonance lines are constituted by inner conductors in resonator holes formed in said dielectric block, said dielectric block having conductor patterns formed on the external surface thereof and continuing from said inner conductors, and wherein the distributed-constant-inductive coupling or the distributed-constant-capacitive coupling is implemented by determining the electrostatic capacitance between portions of adjacent resonance lines near the open-circuit ends of the resonator lines and the electrostatic capacitance between the open-circuit end of the resonance line and the external conductor formed on the external surface of said dielectric block.

3. A communication apparatus comprising:

a transmitting circuit connected to an input port of the first filter of said dielectric duplexer according to claim 1, a receiving circuit connected to an output port of the second filter of said dielectric duplexer; and an antenna connected to a common input/output port of said first and second filters.

4. A communication apparatus comprising:

a transmitting circuit connected to an input port of the first filter of said dielectric duplexer according to claim 2, a receiving circuit connected to an output port of the second filter of said dielectric duplexer; and an antenna connected to a common input/output port of said first and second filters.

* * * * *